US006901853B2

(12) United States Patent
Baldy et al.

(10) Patent No.: US 6,901,853 B2
(45) Date of Patent: Jun. 7, 2005

(54) SPRAY DAMPING UNIT

(75) Inventors: Michael Baldy, Steinfurt (DE); Guido Pinnekamp, Muenster (DE); Maik Brueggemann, Muenster (DE)

(73) Assignee: Technotrans AG, Sassenberg (DE)

( * ) Notice: Subject to any disclaimer, the term of this patent is extended or adjusted under 35 U.S.C. 154(b) by 0 days.

(21) Appl. No.: 10/816,130

(22) Filed: Apr. 1, 2004

(65) Prior Publication Data

US 2004/0206255 A1 Oct. 21, 2004

(30) Foreign Application Priority Data

Apr. 16, 2003 (DE) ..... 103 17 470

(51) Int. Cl.[7] ..... B41F 7/24
(52) U.S. Cl. ..... 101/147; 101/366; 239/568
(58) Field of Search ..... 101/147, 148, 101/366, 365, 131.5; 118/7, 259; 239/568

(56) References Cited

U.S. PATENT DOCUMENTS 3,924,531 A * 12/1975 Klingler ..... 101/147
3,926,115 A * 12/1975 Alsop ..... 101/148
4,064,801 A * 12/1977 Switall ..... 101/147
4,690,055 A * 9/1987 Fadner et al. ..... 101/451
5,025,722 A 6/1991 Switall et al.
5,090,314 A * 2/1992 Miescher et al. ..... 101/148
5,505,126 A * 4/1996 Ohno et al. ..... 101/147
6,192,796 B1 * 2/2001 Hansson ..... 101/147
6,327,974 B1 * 12/2001 Belanger et al. ..... 101/147
6,561,090 B1 * 5/2003 Spooner ..... 101/147

FOREIGN PATENT DOCUMENTS

DE 72 47 187 3/1973
DE 24 60 021 3/1976

* cited by examiner

*Primary Examiner*—Eugene H. Eickholt
(74) *Attorney, Agent, or Firm*—Richard M. Goldberg

(57) ABSTRACT

The invention relates to a spray damping unit for printing machines, with a spray housing attached to a machine frame which extends parallel to and along the roller to be dampened, and a spray bar carrying spray valves, which is adjustably attached on the spray housing in a direction radial to the roller. The spray bar can be additionally adjusted in its longitudinal direction parallel to the roller.

11 Claims, 2 Drawing Sheets

SPRAY DAMPING UNIT

This invention relates to a spray damping unit for printing machines, with a spray housing attached to the machine frame which extends parallel to and along the roller to be dampened, and a spray bar carrying spray valves, which is adjustably attached to the spray housing in a direction radial to the roller.

A spray damping unit of this type is disclosed in EP 1 009 633 B1. In this prior art device there are, at both ends of a spray bar, bearing supports fixed adjustably on the spray bar and/or spray housing in such a way that the spray bar, and hence the spray nozzles too, can be radially adjusted with respect to the roller. The spray bar is disposed as a separate part outside the spray housing and in the rear wall of the spray housing there are openings into which the spray nozzles can be inserted.

The claimed solution is intended to provide a very simple, precise way of adjusting the position of the jet of spray in relation to the roller.

U.S. Pat. No. 5,595,116 describes a spray damping unit in which the spray housing is divided into two parts. The front housing in relation to the roller is rigidly mounted to the frame whilst the rear housing, which carries the valves, can be slightly adjusted in relation to the front housing.

U.S. Pat. No. 5,025,722 describes a damping unit which enables the spray valves to be adjusted in relation to each other, i.e. a reduction or an enlargement in the gaps between the spray valves, thereby providing a means of adjusting the overlap of the spray cones.

DE 198 11 554 in the Applicant's name describes a spray damping unit in which the front part of the spray housing in relation to the roller is rigidly mounted on the frame and the rear part, which carries the spray nozzles, can be swung down. Swinging up the rear part of the spray housing provides access to the spray nozzles for cleaning and maintenance work with no need for further disassembly.

Modern printing machines are often required to be flexible enough for use in different printing procedures.

This invention is therefore based on the task of providing a spray damping unit of the above-mentioned type, which can be quickly and easily adjusted with respect to varying web widths and different requirements in relation to the damping agent.

With a spray damping unit of the above type, this task is solved according to the invention in that the spray bar can be additionally adjusted in its longitudinal direction parallel to the roller.

Radial adjustment of the spray bar, and hence the spray nozzles, in relation to the roller allows changes to be made to the areas of the roller covered by the jets of damping agent. This spray bar, however, can also be adjusted in its longitudinal direction, so that, for example, it can be moved to one or the other side when printing smaller web widths. The spray bar can also be replaced by a longer or shorter spray bar. Overall, this provides a very flexible humidifying system.

The spray bar is preferably supported by at least two mountings disposed in a longitudinally displaceable manner on the spray bar. The spray bar may be continuously adjustable in relation to the mountings or have a certain number of pre-determined positions in which the mountings can, for example, lock in with the spray bar. In one advantageous form of embodiment, the mountings grip the spray bar from underneath like a bracket.

On the other hand, the mountings are fixed in or on the spray housing so as to allow a radial adjustment of the spray bar in relation to the roller. In one preferred embodiment the mountings have fork-shaped fixing strips oriented in the direction of the roller, whose fingers grip both sides of fixing bolts on the floor of the spray housing. Using a nut which is screwed onto the fixing bolts the fixing strips can be held in the desired position.

Preferred examples of embodiments of the invention will be described in more detail below with reference to the enclosed drawings.

Figure 1:
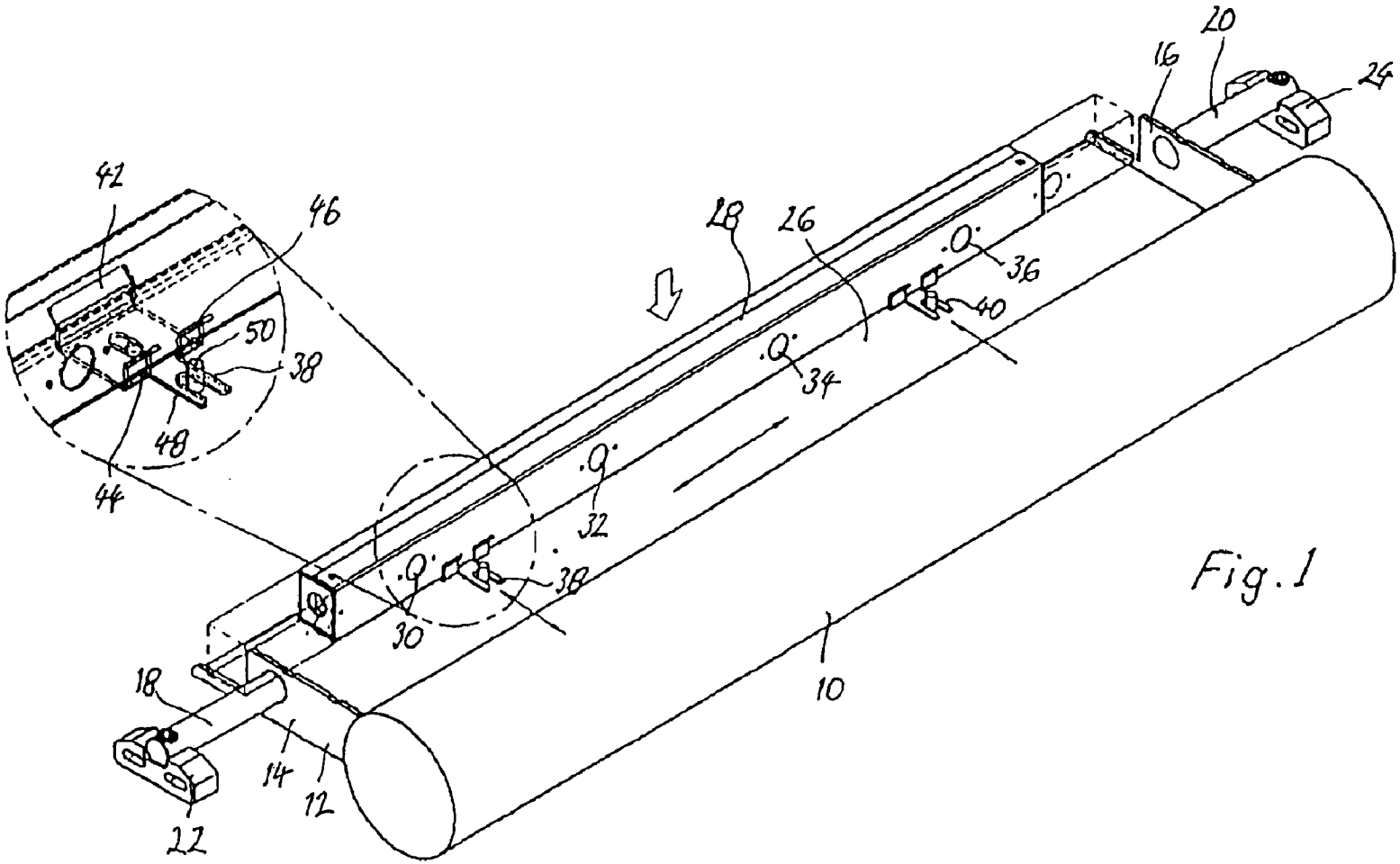
FIG. 1 is a diagrammatic perspective view of a spray damping unit according to the invention, with a detail shown enlarged.

In FIG. 1, a roller, which may, for example, be part of an offset printing machine not shown in its entirety, is designated by 10. Adjacent and parallel to the roller there is a spray housing 12 in the form of a flat, elongated rectangular box, whose upper wall has been omitted for the sake of clarity. Attached to both ends 14,16 of the spray housing there are cylindrical swivel pins 18,20 mounted in bearing bases 22,24. This support permits, if desired, a certain vertical alignment and tilting adjustment of spray housing 12 in relation to roller 10.

In addition to above-mentioned ends 14,16, spray housing 12 also has a floor 26 and the aforementioned upper wall (not shown). The spray housing is open towards the roller, as is also the case in said state of the art. At the back, i.e. the side furthest from roller 10, spray housing 12 is closed off by a spray bar 28. On the side facing towards roller 10 this spray bar 28 has openings 30,32,34,36 for inserting spray nozzles (not shown).

Figure 2:
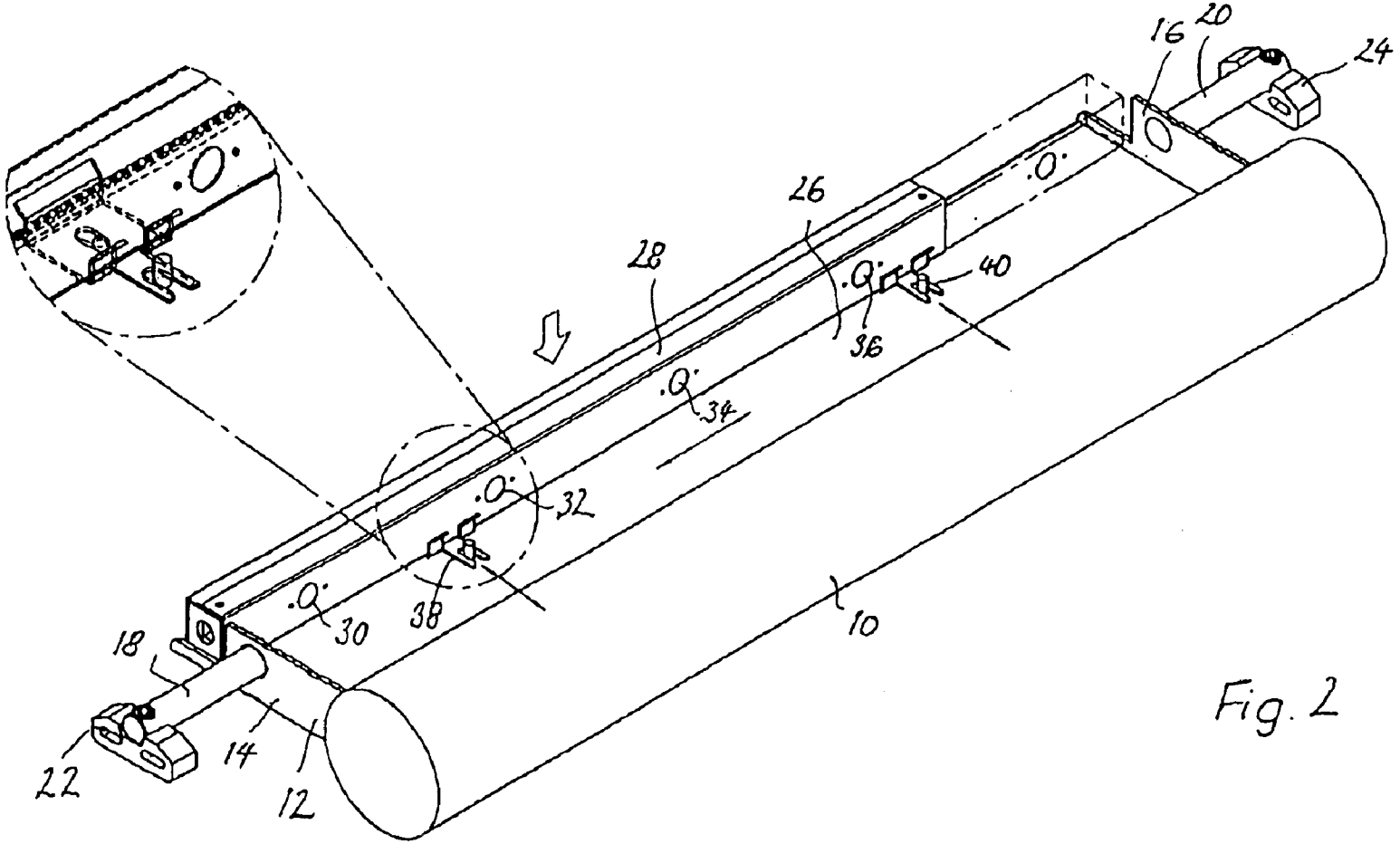
FIG. 2 is the same view, showing the spray bar in an offset position.

Spray bar 28 is attached to spray housing 12 by means of two mountings 38,40, of which one is shown enlarged in FIGS. 1 and 2. Mountings 38,40 are formed by sheet metal brackets for example, which grip spray bar 28 from below with a rear tab 42 and two front tabs 44,46. By providing appropriate beading on the spray bar, the brackets can be clipped onto the underside of the spray bar.

Between the two lateral tabs 44,46 on the front side, i.e. the side facing roller 10, there is, projecting from mounting 38, a fixing strip 48 with a fork-shaped split end that grips both sides of a threaded bolt 50 on the floor 26 of the spray housing. Threaded bolt 50 accommodates a nut (not shown), with which the fixing strip 48 can be clamped in place on the floor 26 of spray housing 12. As the fixing strip 48 is contrived as an open fork, spray bar 28 can be adjusted within certain limits in the direction of the two intimated double arrows in the direction of roller 10 and in the opposite direction. This allows changes to be made to the size of the spray footprint on the roller and the overlap of the individual spray jets.

On the other hand, spray bar 28 can be adjusted parallel to roller 10 by sliding or re-setting it in its longitudinal direction in bracket-shaped mountings 38,40. Whilst spray bar 28 in FIG. 1 is located in a central position in relation to roller 10 and spray housing 12, the spray bar 28 in FIG. 2 is offset to the left in relation to the drawing. As already mentioned, this sidewards adjustment of the spray bar may be continuous or made in pre-determined steps.

Spray bar 28 can also be released from the mountings relatively easily and replaced by another spray bar, a longer spray bar, for example, which covers the entire length of spray housing 12.

What is claimed is:

1. Spray dampening unit for printing machines, comprising:

a spray housing adapted to be attached to a machine frame so as to extend parallel to and along a roller to be dampened, and a spray bar carrying spray valves which is adjustably attached to said spray housing for movement both:

in a direction radial to the roller, and in a longitudinal direction thereof parallel to the roller.

2. The spray damping unit of claim 1, further comprising at least two mountings for longitudinally adjustably supporting the spray bar, the at least two mountings being secured to the spray housing in a radially adjustable manner with respect to the roller.

3. The spray damping unit of claim 2, wherein the mountings are fixed to a floor of the spray housing in a radially adjustable manner with respect to the roller.

4. The spray damping unit of claim 3, wherein the mountings comprise fork-shaped fixing strips oriented towards the roller, and which strips include fingers adapted to grip fixing bolts on the floor of the spray housing.

5. The spray damping unit of claim 2, wherein the spray bar through the mountings, is adapted to be positioned and locked in place, in a plurality of longitudinal positions of the spray bar.

6. The spray damping unit of claim 2, wherein the mountings grip the spray bar from underneath like a bracket.

7. The spray damping unit of claim 3, wherein the spray bar, through the mountings, is adapted to be positioned and locked in place, in a plurality of longitudinal positions of the spray bar.

8. The spray damping unit of claim 4, wherein the spray bar, through the mountings, is adapted to be positioned and locked in place, in a plurality of longitudinal positions of the spray bar.

9. The spray damping unit of claim 3, wherein the mountings grip the spray bar from underneath like a bracket.

10. The spray damping unit of claim 4, wherein the mountings grip the spray bar from underneath like a bracket.

11. The spray damping unit of claim 5, wherein the mountings grip the spray bar from underneath like a bracket.

* * * * *